US010840591B2

(12) United States Patent
Anguera Pros et al.

(10) Patent No.: US 10,840,591 B2
(45) Date of Patent: Nov. 17, 2020

(54) MINIATURE SHARKFIN WIRELESS DEVICE WITH A SHAPED GROUND PLANE

(71) Applicant: Fractus Antennas, S.L., Barcelona (ES)

(72) Inventors: Jaume Anguera Pros, Vinaros (ES); Aurora Andujar Linares, Barcelona (ES); Anna Teotino, Barcelona (ES)

(73) Assignee: Fractus Antennas, S.L., Barcelona (ES)

( * ) Notice: Subject to any disclaimer, the term of this patent is extended or adjusted under 35 U.S.C. 154(b) by 8 days.

(21) Appl. No.: 15/422,044

(22) Filed: Feb. 1, 2017

(65) Prior Publication Data

US 2017/0222302 A1 Aug. 3, 2017

Related U.S. Application Data

(60) Provisional application No. 62/289,415, filed on Feb. 1, 2016.

(51) Int. Cl.

| | |
|---|---|
| ***H01Q 1/32*** | (2006.01) |
| ***H01Q 1/48*** | (2006.01) |
| ***H01Q 5/371*** | (2015.01) |
| ***H01Q 9/42*** | (2006.01) |
| ***H01Q 5/335*** | (2015.01) |

(52) U.S. Cl.

CPC ..... *H01Q 1/48* (2013.01); *H01Q 5/335* (2015.01); *H01Q 5/371* (2015.01); *H01Q 9/42* (2013.01)

(58) Field of Classification Search

CPC .. H01Q 1/24; H01Q 1/48; H01Q 5/30; H01Q 13/106

See application file for complete search history.

(56) References Cited

U.S. PATENT DOCUMENTS

| | | | | |
|---|---|---|---|---|
| 8,203,492 | B2 | 6/2012 | Anguera et al. | |
| 8,952,855 | B2 | 2/2015 | Andujar Linares et al. | |
| 9,130,259 | B2 | 9/2015 | Anguera et al. | |
| 9,331,389 | B2 | 5/2016 | Anguera et al. | |
| 9,379,443 | B2 | 6/2016 | Anguera et al. | |
| 9,997,841 | B2 | 6/2018 | Andujar Linares et al. | |
| 10,249,952 | B2 | 4/2019 | Anguera Pros et al. | |
| 2008/0252538 | A1* | 10/2008 | Ying | H01Q 1/243 343/767 |
| 2012/0223864 | A1* | 9/2012 | Kerselaers | H01Q 1/3275 343/700 MS |

(Continued)

OTHER PUBLICATIONS

Andújar Linares, A. Ground Plane Booster Antenna Technology for Wireless Handheld Devices. Ph. D. Dissertation, May 2013.

(Continued)

*Primary Examiner* — Dameon E Levi
*Assistant Examiner* — David E Lotter
(74) *Attorney, Agent, or Firm* — Edell, Shapiro & Finnan, LLC

(57) ABSTRACT

The described system refers to a Sharkfin wireless device comprising a radiating structure, a feeding system and an external port, the radiating structure comprising at least a radiation booster, a ground plane layer and a conductive element that connects at least one the radiation booster to the ground plane layer. The radiating system arrangement features reduced dimensions and multiband operation including low-frequency bands like LTE700.

20 Claims, 16 Drawing Sheets

(56) References Cited

U.S. PATENT DOCUMENTS

| | | | | |
|---|---|---|---|---|
| 2013/0342416 | A1* | 12/2013 | Andujar Linares ..... | H01Q 1/50<br>343/843 |
| 2014/0015728 | A1* | 1/2014 | Anguera Pros ..... | H01Q 9/06<br>343/843 |
| 2015/0097738 | A1* | 4/2015 | Sugimoto ..... | H01Q 1/3275<br>343/702 |

OTHER PUBLICATIONS

Anguera, J. et al. Advances in Antenna Technology for Wireless Handheld Devices. International Journal of Antennas and Propagation, 2013.

Chen, Z.N., Antennas for Portable Devices, John Wiley & Sons, 2007, pp. 159-163, 252.

* cited by examiner

MINIATURE SHARKFIN WIRELESS DEVICE WITH A SHAPED GROUND PLANE

CROSS REFERENCE TO RELATED APPLICATIONS

This application claims priority under 35 U.S.C. § 119(e) from U.S. Provisional Patent Application Ser. No. 62/289,415, filed Feb. 1, 2016, the entire contents of which are hereby incorporated by reference.

TECHNICAL FIELD

The described system refers to a Sharkfin wireless device comprising a radiating structure, a feeding system and an external port, the radiating structure comprising at least a radiation booster, a ground plane layer and a conductive element that connects the radiation booster to the ground plane layer. The radiating system arrangement features reduced dimensions and multiband operation including low-frequency bands like LTE700.

BACKGROUND

The described system relates to the field of wireless devices, more concretely Sharkfin devices. Typically, a radiating system for a Sharkfin wireless device requires a radiating element of reduced dimensions, which is normally mounted on a metallic roof, such as the roof of a motor vehicle (a car, a truck, an airplane or alike). These devices provide operation in one or more frequency regions and/or bands of the electromagnetic spectrum. They typically operate at LTE bands, GPS, Wifi and/or Wimax bands. So, some of the demands for a radiating system for Sharkfin devices are reduced dimensions and multiband operation including low-frequency bands like LTE700. One of the challenges that emerges when developing devices that require operation at multiple bands that cover operation at low-frequency regions and high-frequency regions is to enlarge the bandwidth at low frequencies while preserving the performance at high frequency region bands. Other demands for these radiating systems are good gain and efficiency performances to achieve good wireless connections.

Currently, Sharkfin devices are quite big devices, whose dimensions are on the order of 170 mm to 270 mm (length)× 90 mm to 110 mm (width)×60 mm to 120 mm (height). Additionally, one finds devices that require customization of their antenna system to meet specific requirements. A device related to the described system comprises a radiating system of reduced dimensions, taking into account that it works at low frequency bands like LTE700, smaller than the prior-art ones, that provides multiband operation at mobile, GPS and Wifi bands, covering low frequency bands, with good gain and efficiency performances. The embodiments related to the described system also benefit from the advantages of Antennaless technology (U.S. Pat. No. 9,130,259 B2) and are also applicable to metering devices, mobile devices, sensors.

As prior-art, one can also make reference to owned patents like for example U.S. Pat. No. 9,379,443 B2, which describes wireless devices comprising a radiating system able to operate in multiple frequency regions, the radiating system comprising a radiating structure, a radiofrequency system and an external port. The devices feature different configurations of the radiating structure thought to optimize the space occupied by the antenna system and to operate in multiple frequency regions. Although these solutions feature a quite performant radio-electric performance a wireless device of smaller dimensions than those described and found in prior-art solutions, featuring operation at low frequency bands like LTE700 would be an advantageous solution since miniaturization of technology is an increasing demand. This problem is solved in the context of the described system by a wireless device arranged according to the described system, which specifically applies to Sharkfin applications.

SUMMARY

It is an object of the described system to provide a wireless device for Sharkfin applications that fulfills the requirements of those devices overcoming the drawbacks of the current technologies or solutions found for these applications. The described Sharkfin wireless device comprises a radiating system configured to operate in multiple bands. The radiating system comprises a radiating structure, a feeding system, and an external port. The radiating structure includes at least one radiation booster, a ground plane layer, and a conducting element connecting the at least one radiation booster to the ground plane layer. The feeding system includes a radiofrequency system and a transmission line. The radiating system is connected to an additional ground plane via a conductive element that connects the ground plane layer of the radiating structure to the additional ground plane.

BRIEF DESCRIPTION OF THE DRAWINGS

FIG. 4*a* and FIG. 4*b* provide embodiments including a convex slot in the ground plane layer. FIG. 4*c* to FIG. 4*e* present different examples comprising a concave slot.

FIG. 5*a* presents the BAR mXTEND booster. FIG. 5*b* shows the RUN mXTEND booster. FIG. 5*c* shows the ALL mXTEND booster.

DETAILED DESCRIPTION

Figure 1:
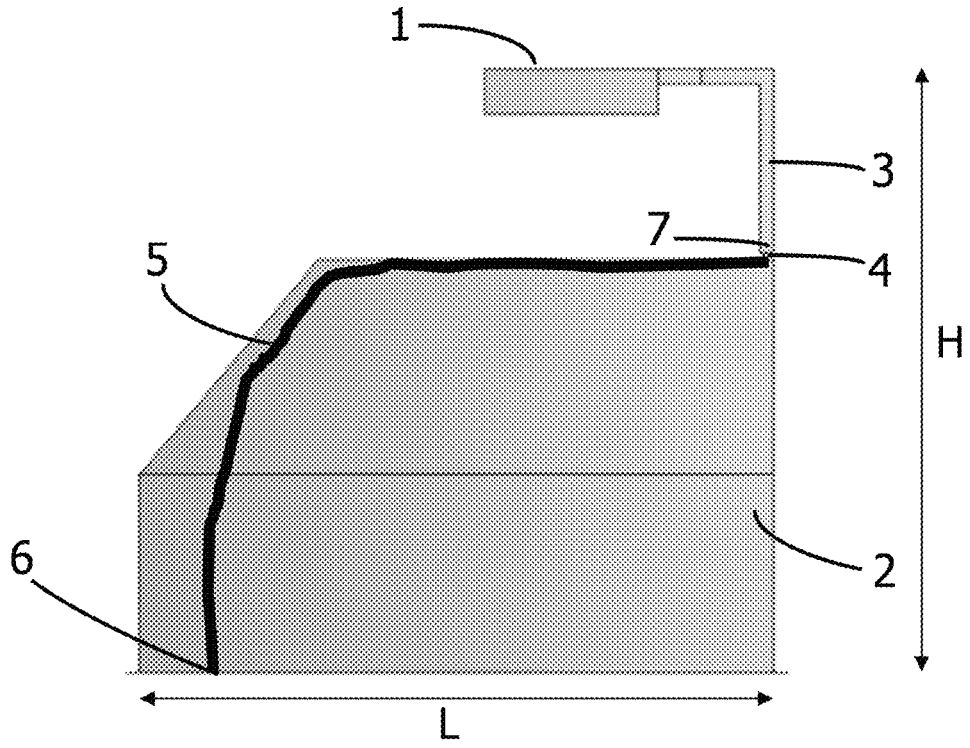
FIG. 1 shows a multiband example of the described system of reduced dimensions that operates at low-frequency bands like LTE700.

Generally, a device related to the described system is a small device according to its low operation frequencies, with multiband or multi-region behavior. It comprises a radiating system which comprises a radiating structure, a feeding system and an external port as shown in FIG. 1, the radiating system mounted, typically on a vertical position relative to an additional ground plane that plays the role of metallic roof. The radiating system related to a device according to the described system is connected to the additional ground plane by a conducting element that connects the ground plane of the radiating structure of the device to the additional ground plane.

More specifically, as shown in FIG. 1, the radiating structure of the device comprises at least one radiation booster 1, a ground plane layer 2, and a conductive element 3 that connects the at least one radiation booster (or boosters) 1 to the ground plane layer 2. It has been found that the radiating system arrangement features reduced dimensions, meaning a ratio between the height of the radiating structure and the free-space wavelength corresponding to the lowest operation frequency smaller than 0.16 or preferably smaller than 0.1. The height of the radiating structure can be reduced in some embodiments by placing it on the roof ground plane with a non-vertical position. Some embodiments of the described system comprise a strip line to connect the ground plane to at least one radiation booster included in the radiating structure. It has been found that a conducting element featuring a non-linear shape that connects the booster to the ground plane layer modifies the input impedance, improving the input matching and the operation bandwidth related to a device according to the described system.

A feeding system according to the described system comprises a radiofrequency system 4 and a transmission line 5, which connects the radiofrequency system to an external RF port 6. The radiofrequency system includes a matching network that tunes the impedance at the feeding point 7 to match the input/output impedance of the external RF transceiver port. Generally, the matching network is a multiband matching network (FIGS. 2*a*-2*c*) that provides multiband behavior for covering both low-frequency and high-frequency bands. Typically, a device related to the described system covers mobile bands like for example, but not limited to: LTE700, GSM850, GSM900, UMTS2100, LTE2300, LTE2500 and LTE2600, in addition to GPS and Wifi bands.

Figure 2A:
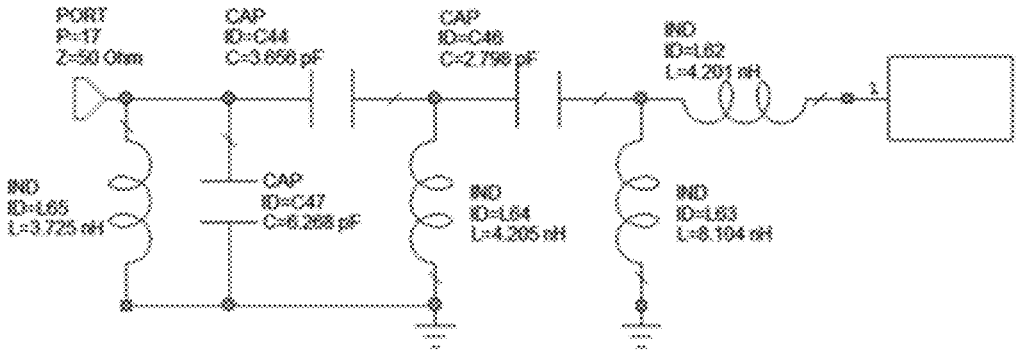
FIGS. 2*a*-2*c* present examples of multiband matching networks able to match the embodiments of the described system.
Figure 2B:
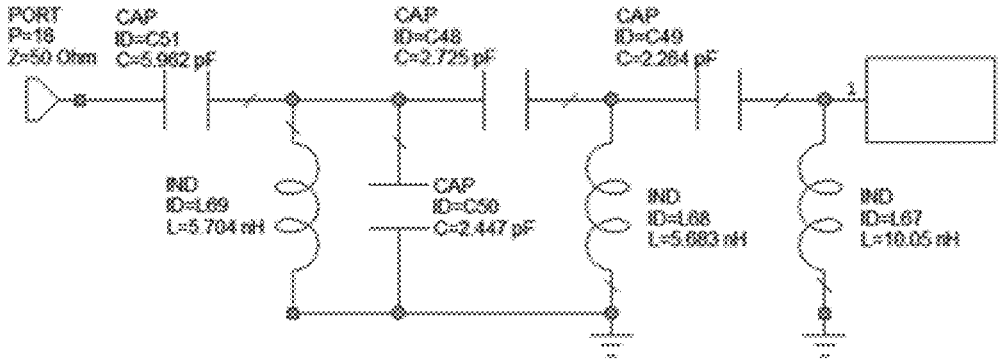
Figure 2C:
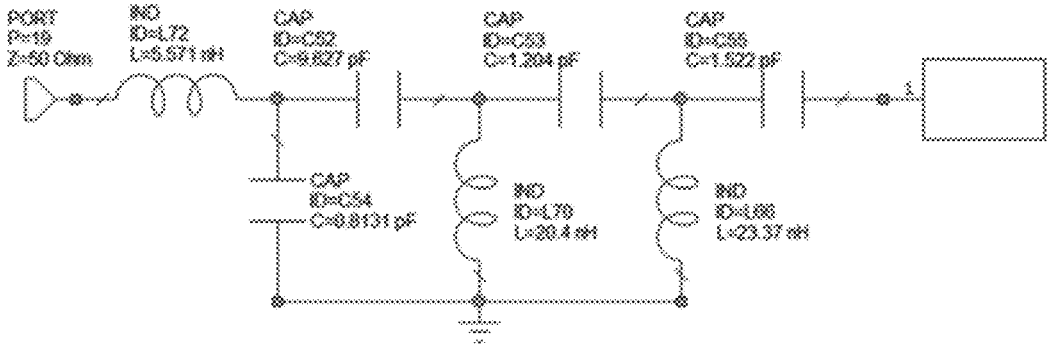

Referring to FIGS. 2*a*-2*c*, three topologies of examples of the matching network included in the radiofrequency system of the radiating structures described in the context of the described system are shown. These matching networks are examples that can be used to match the embodiments related to the described system at multiple bands comprised in two frequency regions, low-frequency region and high-frequency region.

The radiating system comprised in some embodiments includes a radiating structure comprising a ground plane layer that comprises a convex conducting surface. However, the electromagnetic performance of a wireless device related to the described system can be further improved by shaping the ground plane layer of its radiating system. In particular, by using a non-convex (i.e., concave) conductive ground plane layer, better performance is achieved in terms of input return losses, particularly at low frequencies of operation, like for example at LTE700. Shaping the ground plane layer is also useful to obtain better efficiencies and gains at low frequency ranges of operation than the ones obtained with a conventional convex ground plane geometry.

Figure 3:
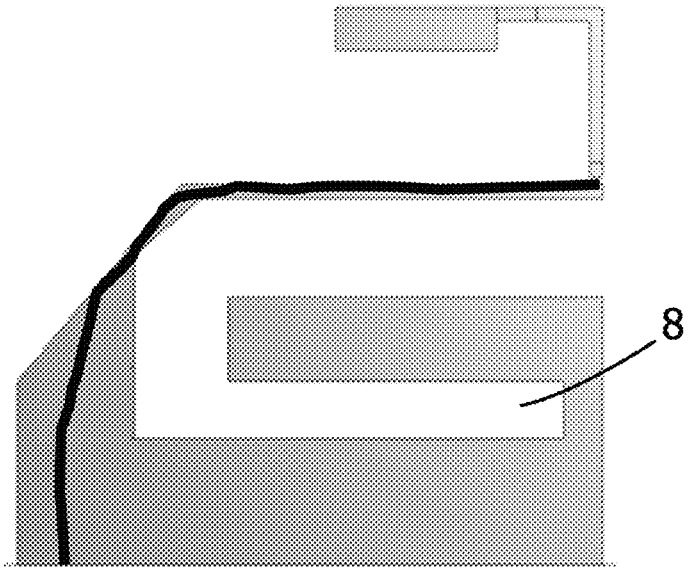
FIG. 3 illustrates a multiband example of the described system featured for its small dimensions and for comprising a slotted ground plane layer.
Figure 4A:
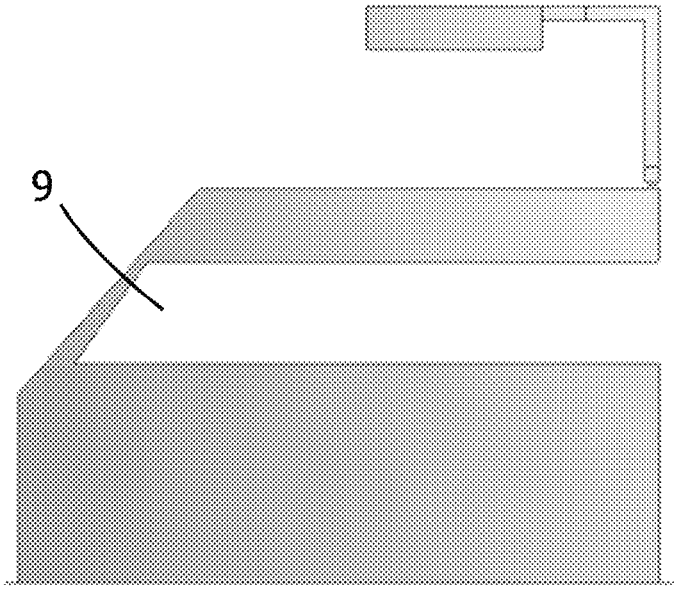
FIGS. 4*a*-4*e* illustrate different embodiments that comprise a slotted ground plane layer.
Figure 4B:
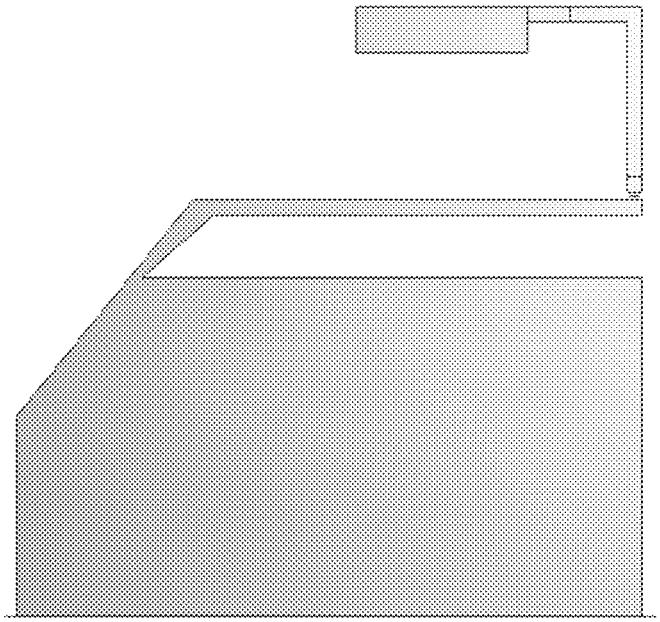
Figure 4C:
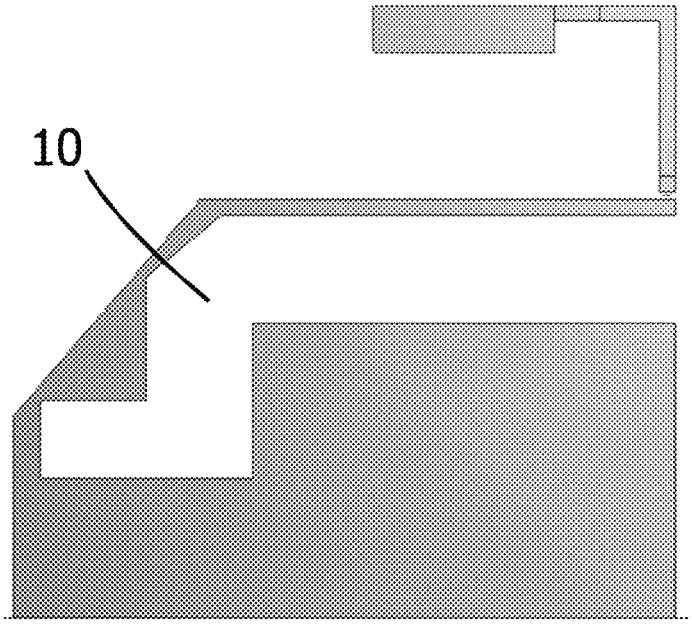
Figure 4D:
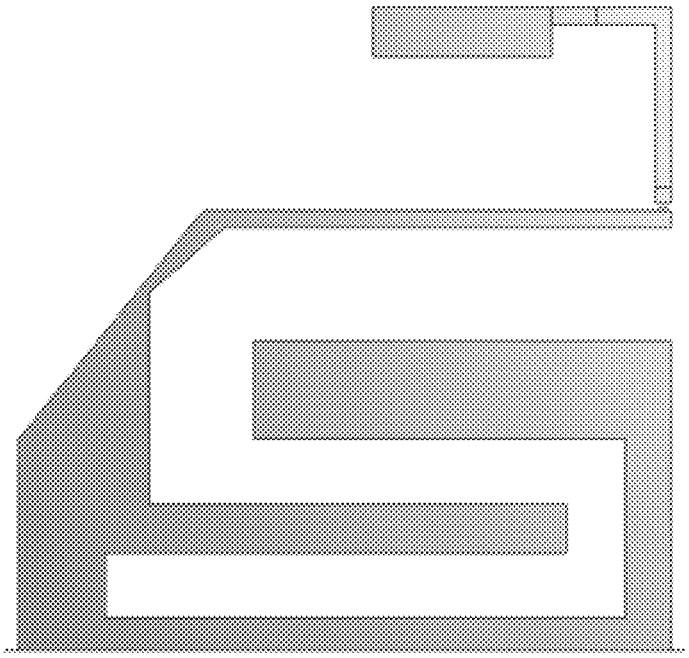
Figure 4E:
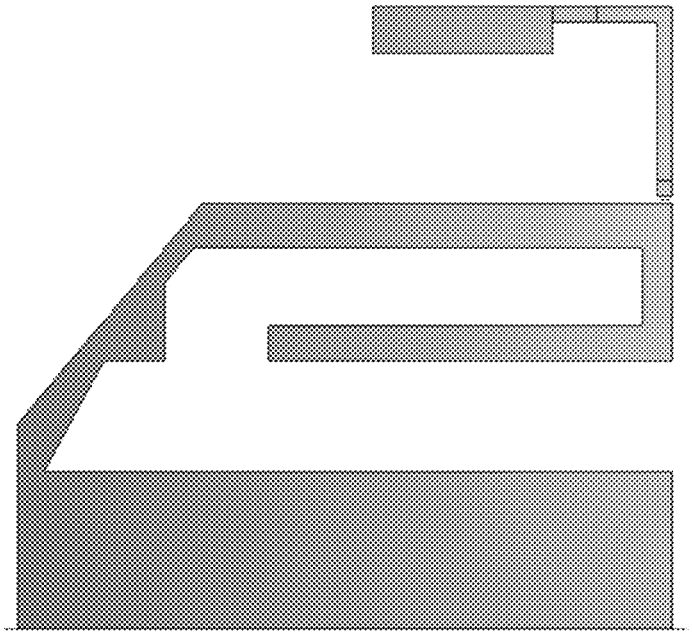

In some embodiments the aforementioned shaped ground plane layer is a concave conducting surface or contains at least one concave conducting surface, and more specifically some of these embodiments comprise a slotted ground plane layer with at least one slot 8, as shown in FIG. 3. Additional embodiments with different slot shapes included in the ground plane layer of the radiating structure related to the described system are provided in FIGS. 4*a*-4*e*. Some of the embodiments include at least one convex slot 9 and other embodiments include at least one concave slot 10. Illustrative examples of embodiments comprising a convex slot are provided in FIG. 4*a* and FIG. 4*b* and examples of embodiments comprising a concave slot are shown in FIG. 4*c* to FIG. 4*e*, without any limiting purpose.

Figure 5A:
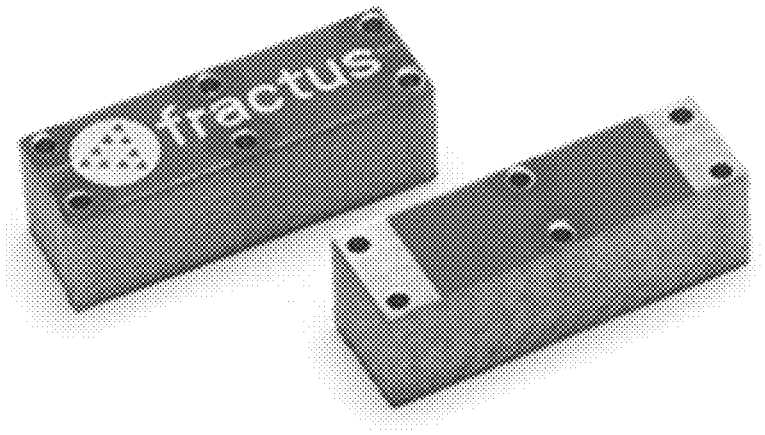
FIGS. 5*a*-5*c* show examples of commercial boosters.
Figure 5B:
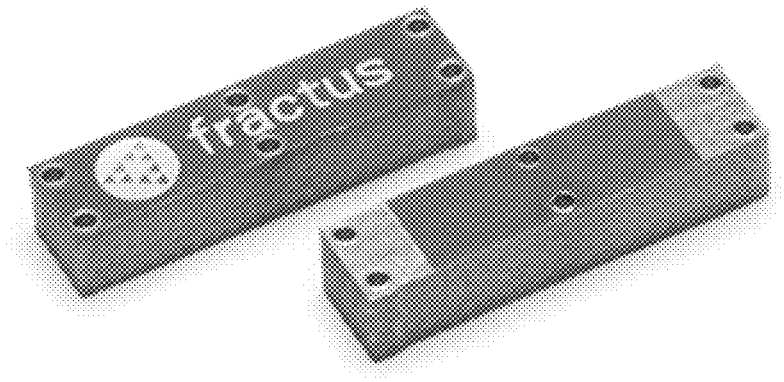
Figure 5C:
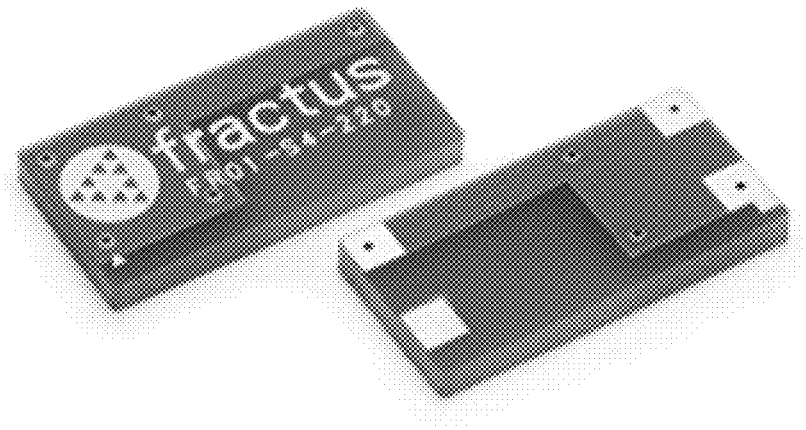

Generally, a device according to the described system comprises volumetric booster elements like for example the ones described in U.S. Pat. No. 9,331,389B2 or the commercial ones of the mXTEND range of products of different sizes (FIGS. 5*a* and 5*b*) presented at http://www.fractusantennas.com/products/. But, in some other embodiments the at least one booster element is a flat or planar booster without significant volume, as shown in FIG. 5*c*. An additional benefit related to the use of non-convex ground plane layers in devices related to the described system is the reduction of the dimensions of the radiation booster or boosters without performance loss.

In some other embodiments the shaped ground plane serves to simplify the topology of the radiofrequency system by reducing the number of components of its matching network.

In some embodiments the ground plane layer is printed on a substrate like FR4, Cuclad or Alumina.

Figure 6:
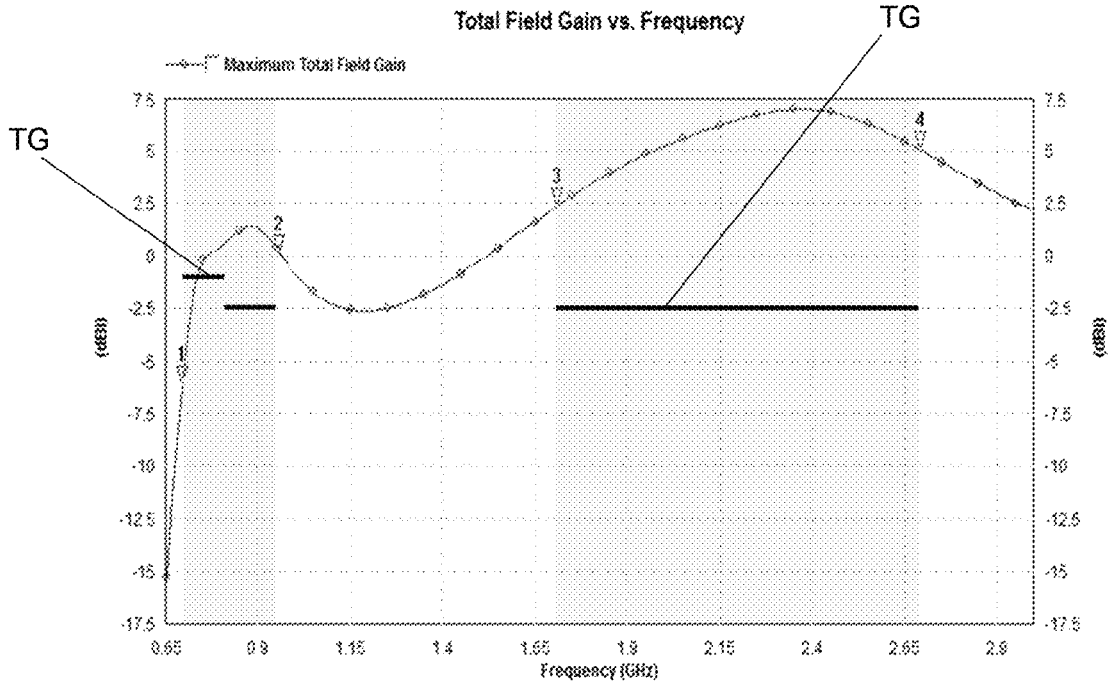
FIG. 6 provides the maximum total gain related to the example from FIG. 1.

Some specific examples of wireless devices related to the described system are provided without any limiting purpose but the only one of providing illustrative examples. FIG. 1 shows an example of small dimensions 43.8 mm (L)×1 mm (W)×39 mm (H), suitable for Sharkfin applications. The embodiment comprises a RUN mXTEND booster of dimensions 12×3×2.4 $mm^3$. The radiating structure shown in FIG. 1 is perpendicularly mounted on another ground plane that is connected to the ground plane of the radiating structure. The dimensions of the additional ground plane are 60 cm×60 cm. FIG. 6 provides the maximum gain related to this embodiment. Even if this example operates correctly within the frequency ranges 698 MHz-960 MHz and 1.71 GHz-2.69 GHz, its maximum gain at LTE700 is below a target performance TG of at least −1 dBi.

Figure 7:
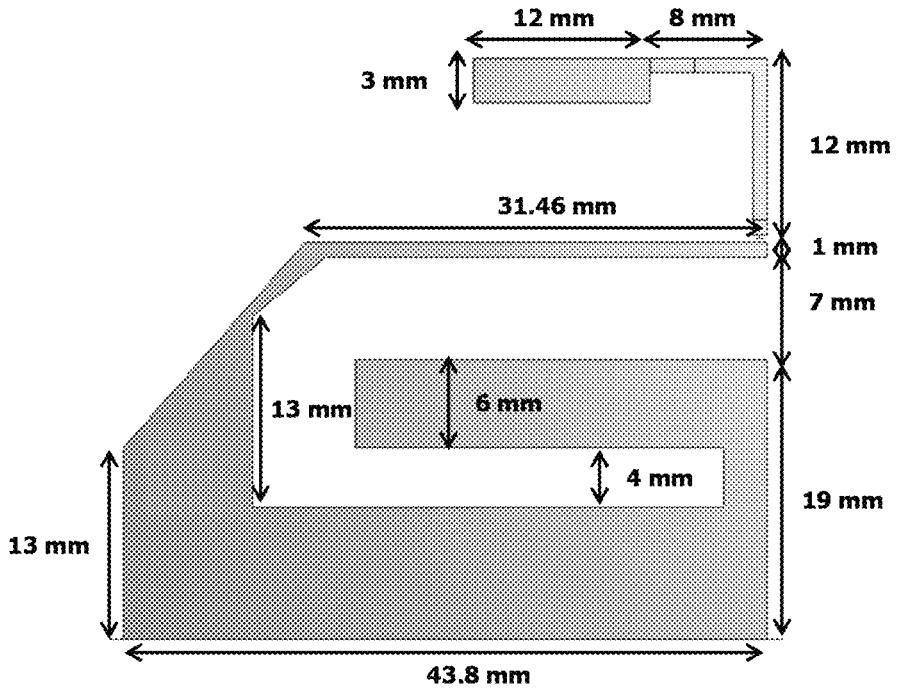
FIG. 7 presents an embodiment that comprises a slotted ground plane layer including its dimensions.

FIG. 7 illustrates another embodiment, which comprises a concave slotted ground plane layer. It also includes a RUN mXTEND booster placed at 12 mm from the ground plane. The dimensions of this specific embodiment are included in FIG. 7. The embodiment is also perpendicularly mounted on a ground plane of dimensions 60 cm×60 cm and connected to it by a conducting element that connects the embodiment ground plane layer to the additional ground plane of 60 cm×60 cm dimensions. The embodiment here described comprises a matching network like for example the ones included in FIGS. 2*a*-2*c*. Each topology example shown in FIGS. 2*a*-2*c* has seven components, but the topology of a matching network comprised in an embodiment related to the described system is not limited to the ones presented in FIGS. 2*a*-2*c*, either for example in number of components or configuration.

Figure 8:
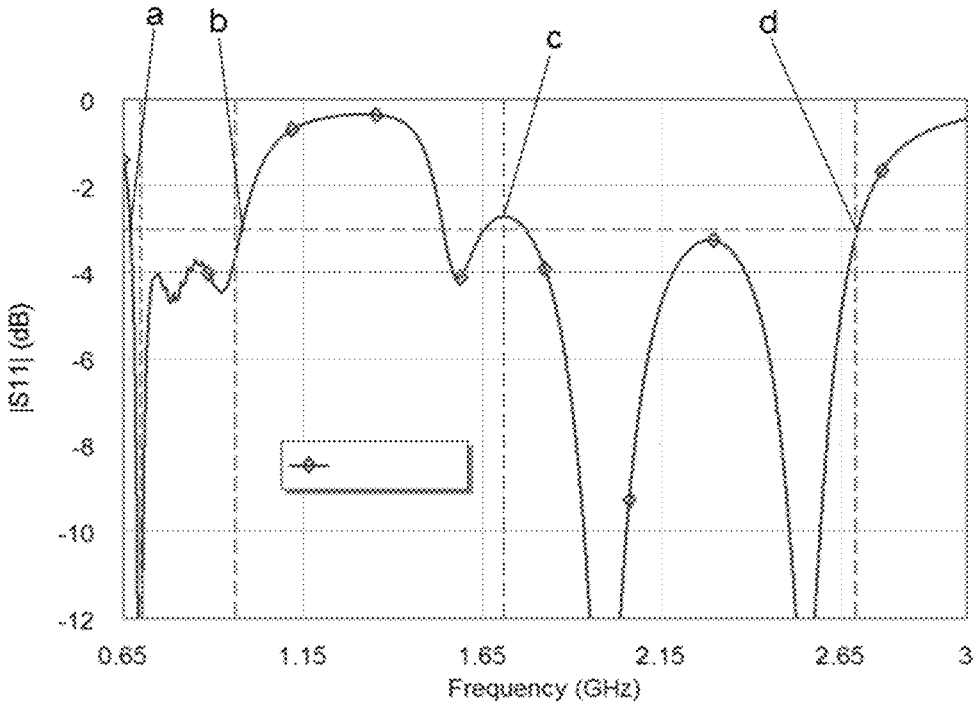
FIG. 8 provides the input return loss of the slotted embodiment from FIG. 7.

FIG. 8 shows the input reflection coefficient related to this embodiment. The radiating structure operates from 698 MHz to 960 MHz (bandwidth delimited in the figure by points a and b), which corresponds to the commercial mobile communication bands LTE700, GSM850 and GSM900. The slotted ground plane layer enables operation at LTE700 with better performance than the one obtained for a radiating structure with a conventional convex ground plane layer of the same dimensions (embodiment from FIG. 1). It also covers operation in the 1.71 GHz to 2.69 GHz frequency range (delimited in the figure by points c and d), which includes LTE1700, GSM1800, GSM1900, UMTS2100, LTE2300, LTE2500 and LTE2600.

Figure 9:
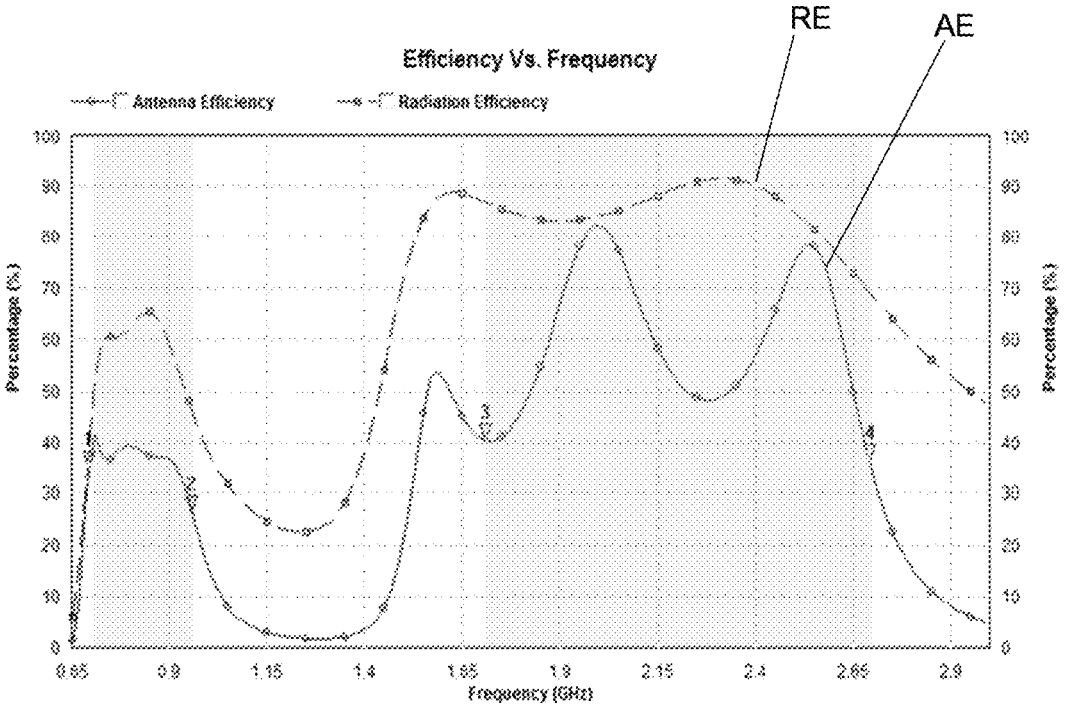
FIG. 9 presents the radiation and antenna efficiencies related to the slotted embodiment from FIG. 7.

FIG. 9 presents the efficiency that corresponds to the example shown in FIG. 7. Curve RE represents the radiation efficiency and curve AE represents the antenna efficiency, which takes into account the mismatch input losses. The antenna efficiency average of this embodiment in the low-frequency range of operation (limited by 1 and 2) is 35.6% and in the high-frequency range of operation (limited by 3 and 4) is 60.1%.

Figure 10:
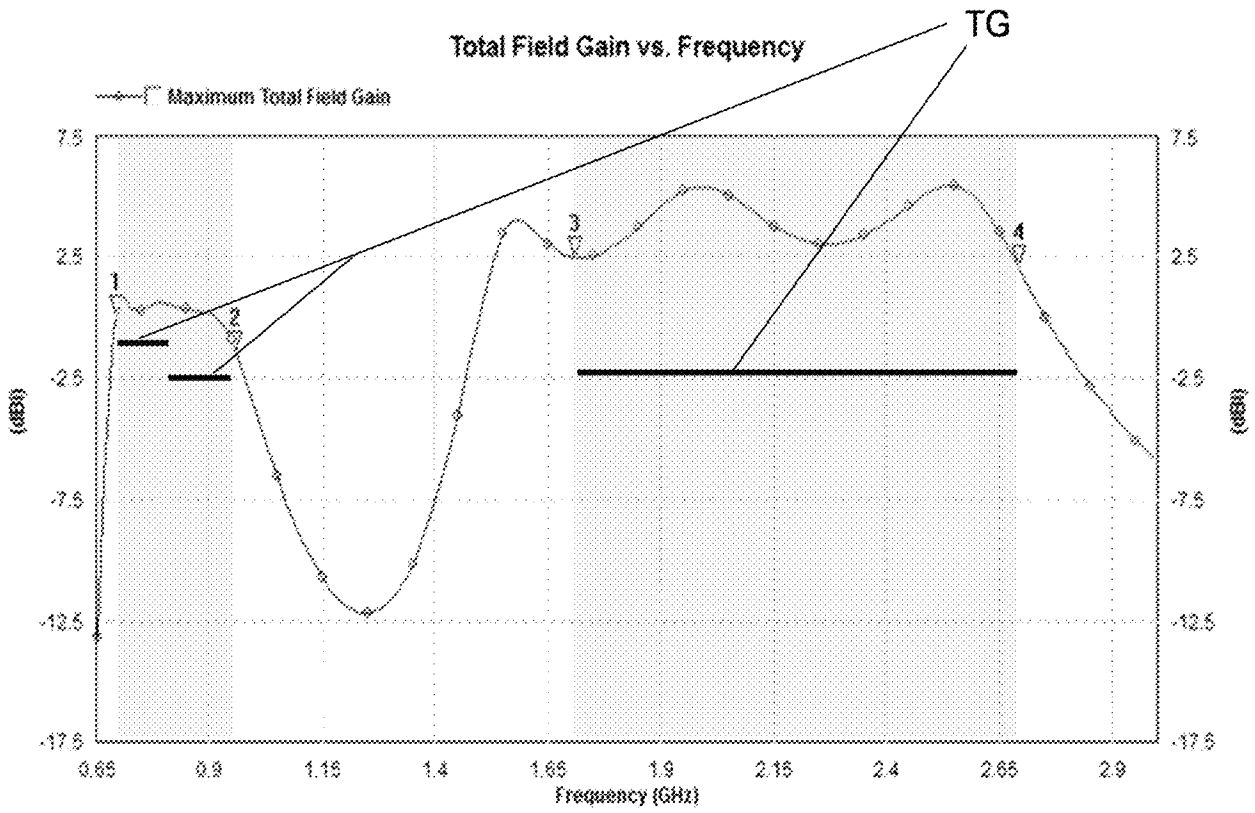
FIG. 10 presents the maximum total gain provided by the slotted example from FIG. 7.

FIG. 10 provides the maximum gain corresponding to the embodiment described in FIG. 7. The horizontal solid lines TG indicate target values, at least −1 dBi from 700 MHz to 800 MHz and at least −2.5 dBi from 800 MHz to 960 MHz and from 1.71 GHz to 2.69 GHz. The maximum gain average obtained at the low frequency range of operation is 0.1 dBi and at the high-frequency operation range is 4.1 dBi. In this case, the target values are achieved in all the ranges of operation frequencies of the embodiment.

Figure 11A:
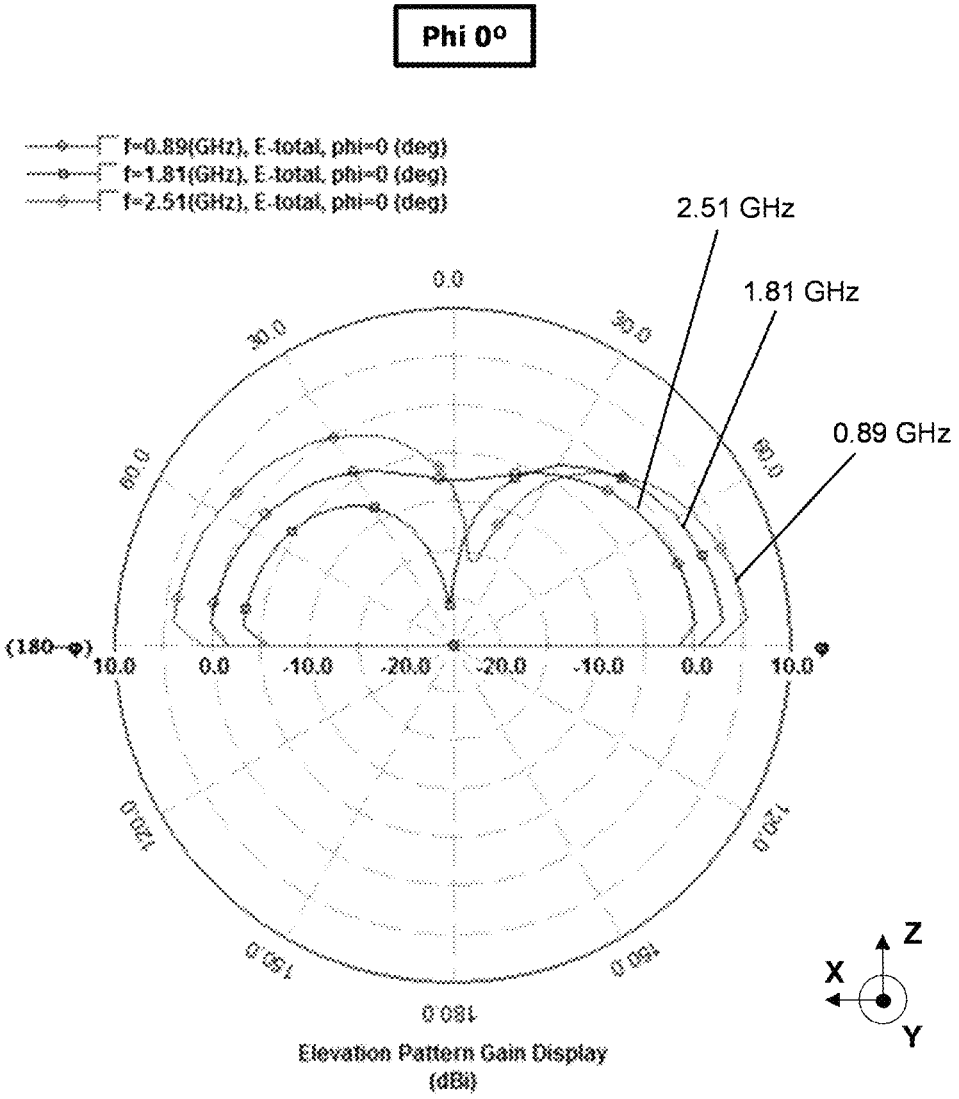
FIGS. 11*a* and 11*b* show vertical cuts of the radiation patterns related to the example from FIG. 7.
Figure 11B:
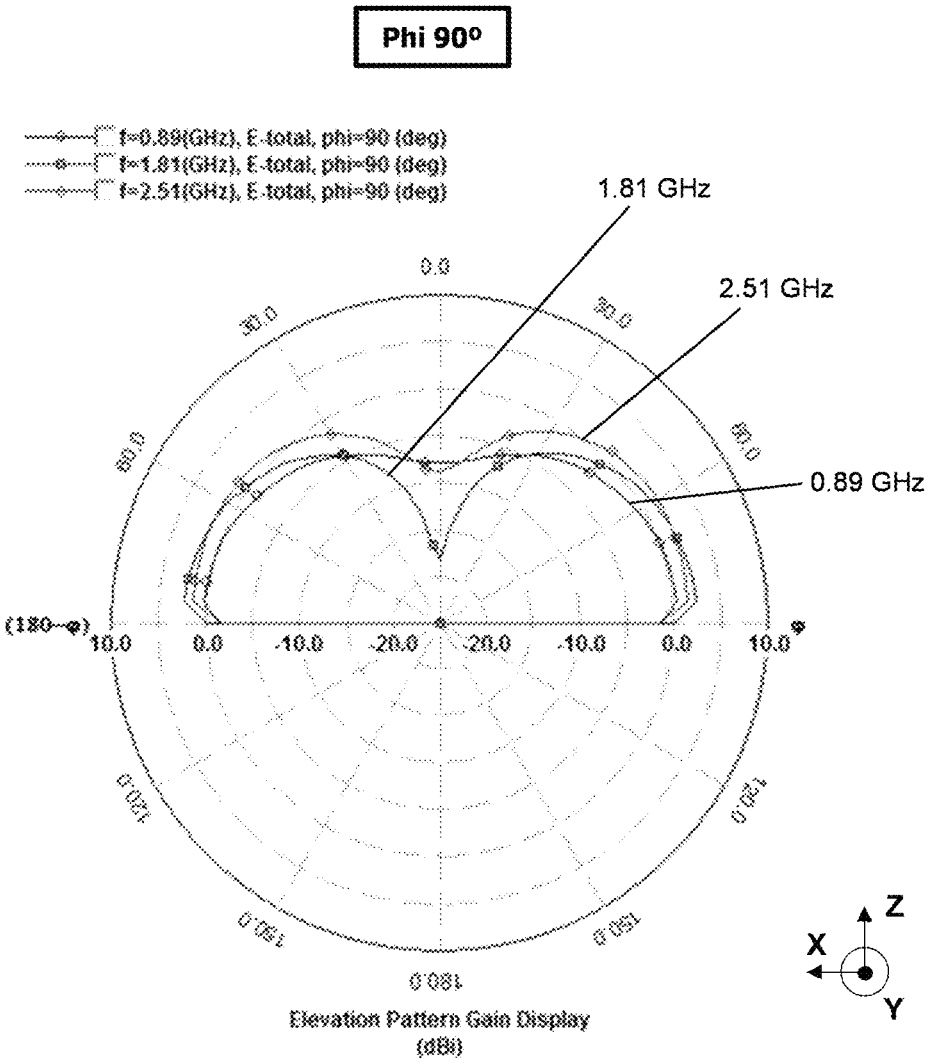

FIGS. 11*a* and 11*b* respectively provide, for $\varphi=0°$ and $\varphi=90°$, the vertical cuts of the radiation patterns related to the example from FIG. 7 at three different frequencies within the frequency ranges of operation shown in FIG. 7.

Figure 12:
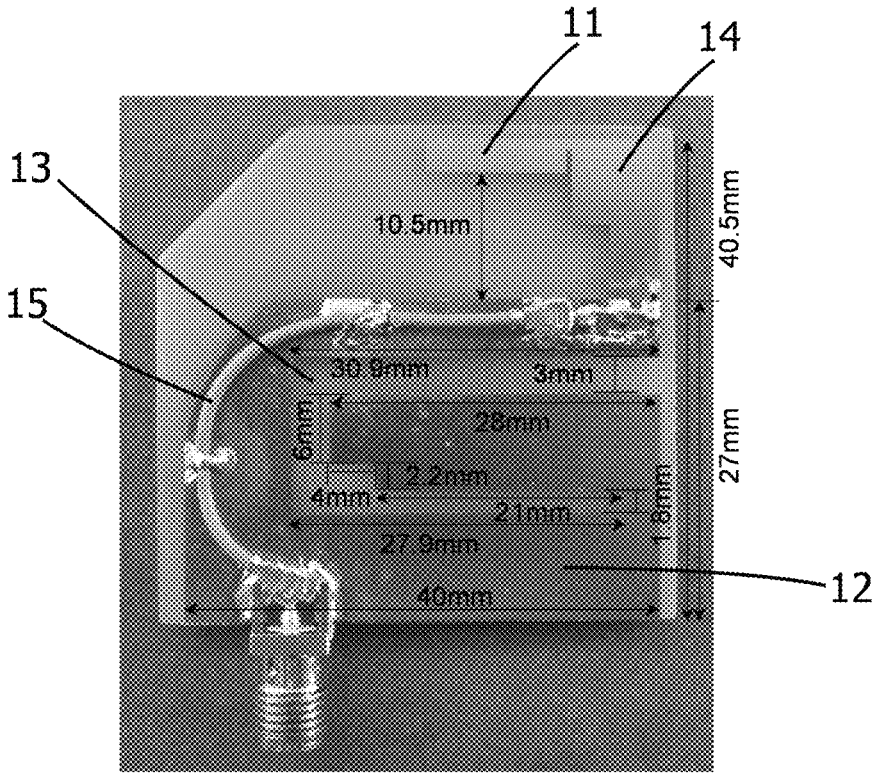
FIG. 12 presents an embodiment comprising a non-volumetric booster.
Figure 13:
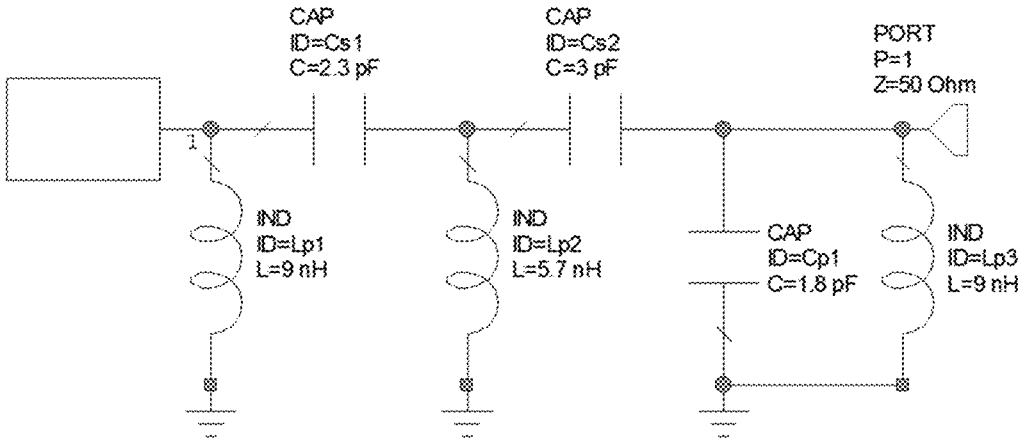
FIG. 13 provides a matching network implemented to match the embodiment shown in FIG. 12.

Some other examples do not include a volumetric booster element, like for example the mXTEND range of products, but a flat or planar booster element. FIG. 12 provides an embodiment that comprises a flat booster element 11. The dimensions related to the embodiment are also included in FIG. 12. The dimensions provided are related to this specific example but they are not provided with any limiting purpose for any embodiment related to the described system. The ground plane included in the radiating system of this concrete example is a concave ground plane 12 that contains a concave bent slot 13 with a determined shape optimized to enhance the performance of the device, in terms of bandwidth and efficiency and gain performance. The radiating system also comprises a modified non-linear strip 14 as conductive element that connects the flat booster element to the ground plane layer. This particular footprint shape improves the performance with respect to the one provided by an embodiment that contains a linear strip line. The matching network included in the radiofrequency system of the embodiment shown in FIG. 12 is provided in FIG. 13. The transmission line that connects the radiofrequency system of the embodiment to the external RF port is a coaxial UFL cable 15. The measured performance of the embodiment is provided in the following figures.

Figure 14:
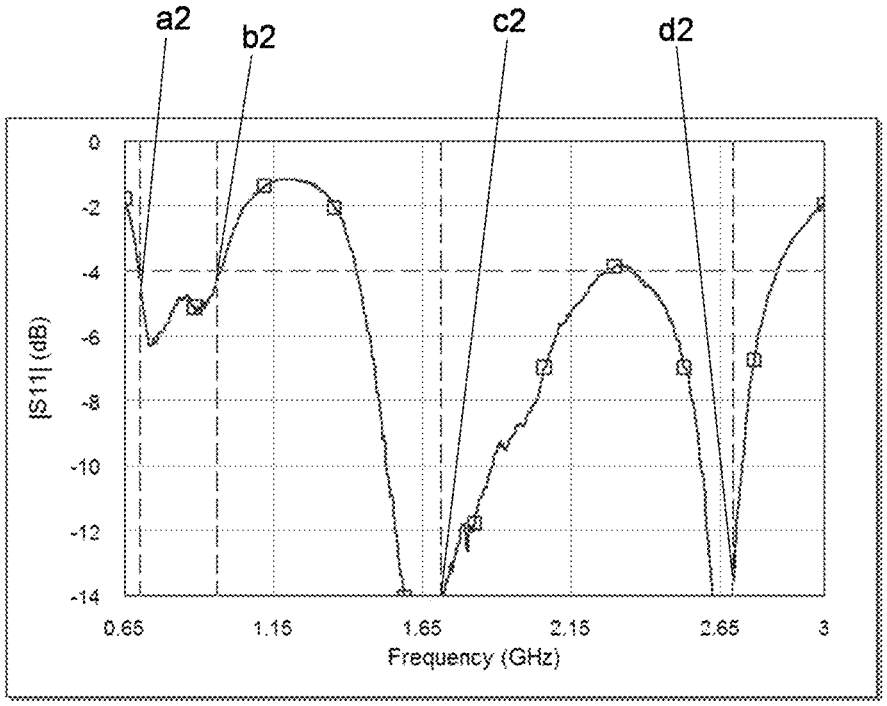
FIG. 14 shows the measured input reflection coefficient related to the embodiment provided in FIG. 12.

FIG. 14 shows the input reflection coefficient related to the embodiment presented in FIG. 12. The radiating structure operates at low-frequency region from 698 MHz to 960 MHz (bandwidth delimited in FIG. 14 by points a2 and b2), which corresponds to the commercial mobile communication bands LTE700, GSM850 and GSM900. It also covers operation in the 1.71 GHz to 2.69 GHz frequency range (delimited in the figure by points c2 and d2), which includes LTE1700, GSM1800, GSM1900, UMTS2100, LTE2300, LTE2500 and LTE2600. Such embodiment features an input reflection coefficient below −4 dB within the frequency ranges of operation.

Figure 15:
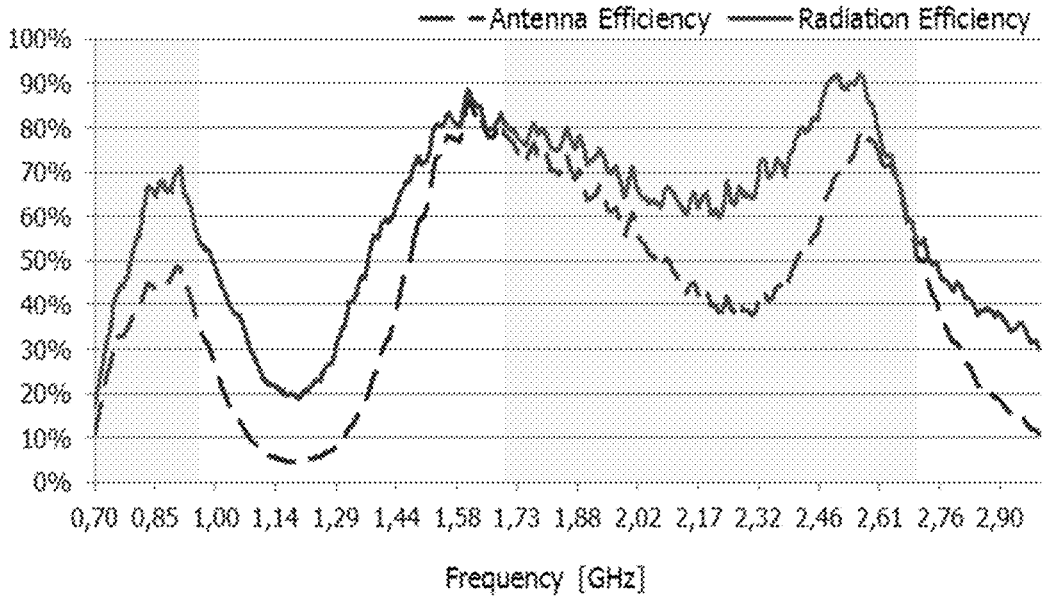
FIG. 15 shows the measured efficiencies related to the embodiment presented in FIG. 12.

According to the performance related to the example presented in FIG. 12, FIG. 15 presents the measured efficiency that corresponds to the example. The solid curve represents the radiation efficiency and the dashed curve represents the antenna efficiency, which takes into account the input return losses shown in FIG. 14. The antenna efficiency average of this embodiment in the low-frequency range of operation (delimited by the grey area colored at low frequencies in FIG. 15) is 37.4% and in the high-frequency range of operation (delimited by the grey area included at high frequencies in FIG. 15) is 58.3%.

Figure 16:
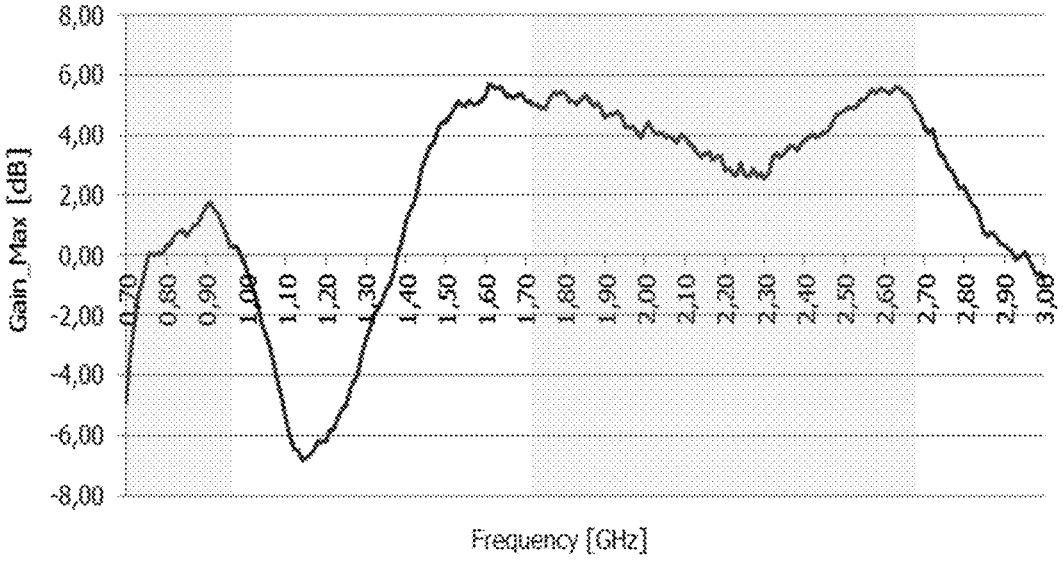
FIG. 16 illustrates the measured maximum gain related to the embodiment presented in FIG. 12.

Referring to FIG. 16, the maximum gain corresponding to the embodiment described in FIG. 12 is provided. The maximum gain average obtained at the low frequency range of operation is 0.12 dBi and the average at the high-frequency operation range is 4.28 dBi.

Figure 17:
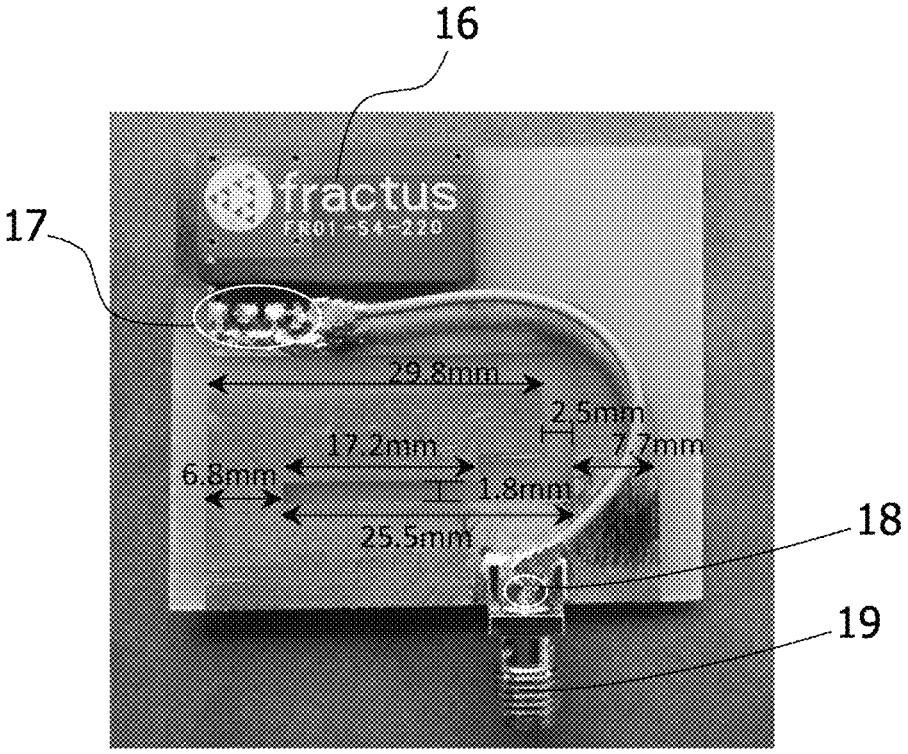
FIG. 17 presents an embodiment that comprises an ALL mXTEND booster.

Other examples comprise at least one ALL mXTEND booster (FIG. 5*c*), whose dimensions are 24 mm×12 mm×2 mm. More specifically, FIG. 14 provides an embodiment that comprises an ALL mXTEND booster 16 and a slotted ground plane layer that comprises a concave bent slot with the shape and dimensions shown in FIG. 14. The dimensions provided are related to this specific example but they are not provided with any limiting purpose for any embodiment related to the described system. Again, the embodiment is mounted vertically on a ground plane sheet of dimensions 60 cm×60 cm. The embodiment is electrically connected to the additional ground plane by means of a conductive element that connects the ground plane layer comprised in the radiating structure of the device to the 60 cm×60 cm ground plane. Like the embodiment provided in FIG. 12, the ALL booster one presented in FIG. 17 comprises a coaxial UFL cable as transmission line to connect the radiofrequency system 17 to the external port 18, ended by an SMA connector 19.

Figure 18:
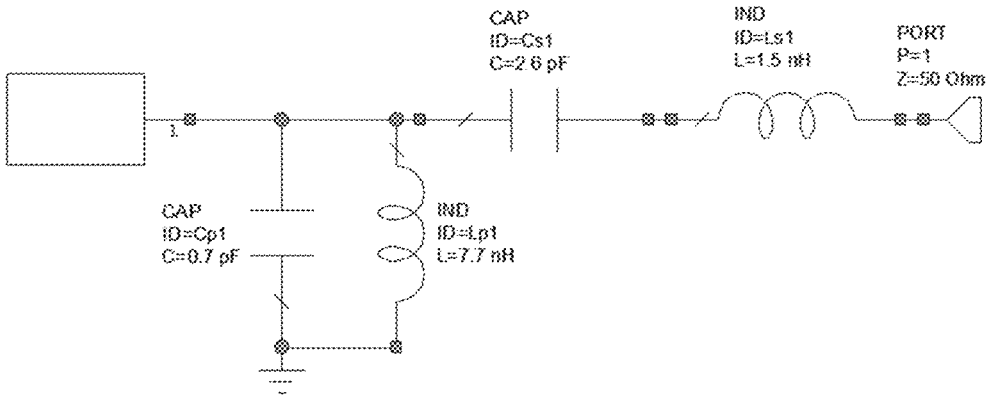
FIG. 18 provides the matching network implemented to match the embodiment shown in FIG. 16.

Referring to FIG. 18, the matching network included in the radiofrequency system used to match the embodiment that comprises an ALL mXTEND booster presented in FIG. 14 is provided. The matching network comprises four components disposed as shown in the topology from FIG. 18.

Figure 19:
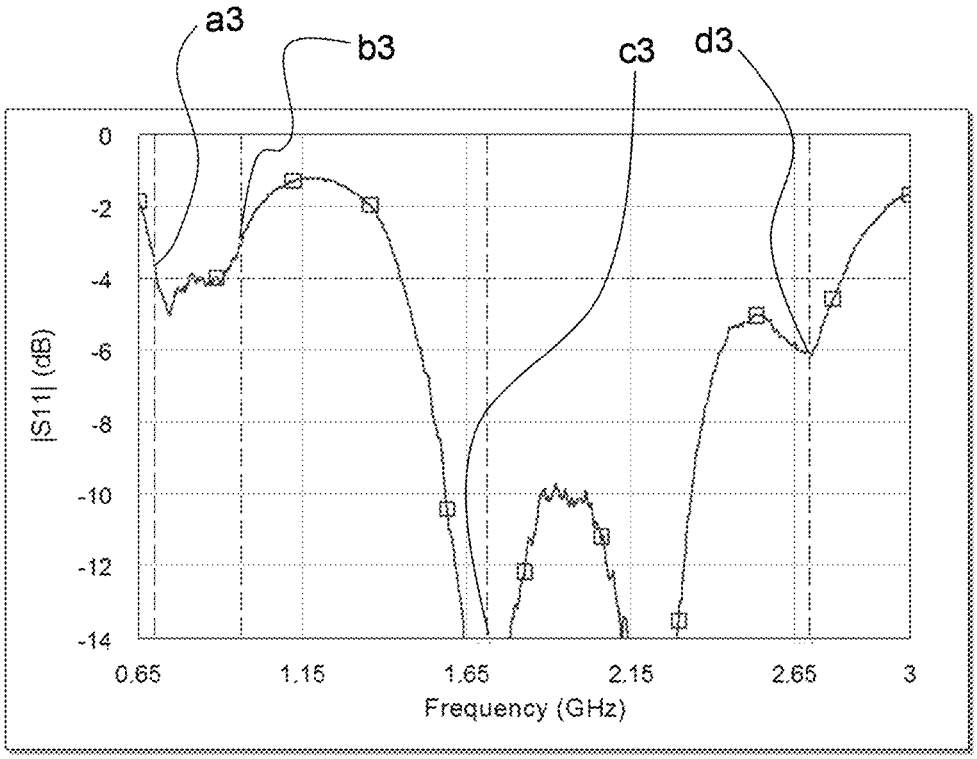
FIG. 19 presents the measured input reflection coefficient related to the embodiment shown in FIG. 16 that comprises the matching network presented in FIG. 17.

FIG. 19 presents the measured input reflection coefficient related to the embodiment shown in FIG. 14, matched with the matching network composed of four components included in FIG. 18. The radiating system, configured as aforementioned, operates from 698 MHz to 960 MHz (bandwidth delimited in the figure by points a3 and b3), which corresponds to the commercial mobile communication bands LTE700, GSM850 and GSM900. It also covers operation in the 1.71 GHz to 2.69 GHz frequency range (delimited in the figure by points c3 and d3), which includes LTE1700, GSM1800, GSM1900, UMTS2100, LTE2300, LTE2500 and LTE2600. Such matching network allows to match the embodiment providing an input reflection coefficient below −3 dB in the frequency ranges of operation. Other matching network topologies comprising more number of components are also possible candidates to match the embodiment. The four-components topology is simple and having few components avoids adding components losses. Such an elements arrangement and the system configuration provides the gain performance shown in FIG. 20.

Figure 20:
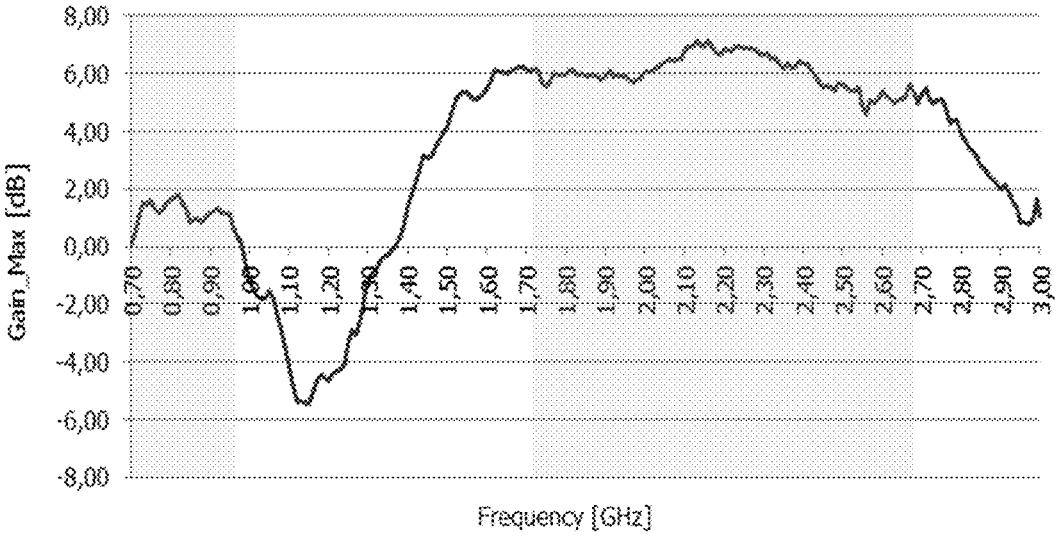
FIG. 20 represents the measured maximum gain related to the example provided in FIG. 16.

FIG. 20 provides the measured maximum gain corresponding to the embodiment described in FIG. 14. The gain is higher than 0 dBi within the low-frequency range of operation according to the input reflection coefficient shown in FIG. 19. The maximum gain average obtained at the low frequency range of operation is 1.18 dBi and at the high-frequency operation range is 6 dBi.

Even though that some examples of radiating systems (such as for instance, but not limited to, those provided in FIG. 1, 7, 12 or 17) have been described, other examples according to an arrangement related to the described system could have been constructed.

What is claimed is:

1. A device comprising:

a radiating system of a device that operates in multiple bands, the radiating system comprising:

a radiating structure including:

at least one radiation booster;

a ground plane layer connectable to an external ground plane; and a conducting element connecting the at least one radiation booster to the ground plane layer;

an external RF port; and a feeding system including a radiofrequency system and a transmission line arranged along the ground plane layer and connecting the radiofrequency system to the external RF port, the radiofrequency system comprising a multiband matching network connected to the at least one radiation booster, the ground plane layer, and the external RF port to provide impedance matching for the radiating system over multiple mobile communication bands.

2. The device of claim 1, wherein the ground plane layer of the radiating structure comprises at least a concave conductive surface.

3. The device of claim 2, wherein the ground plane layer of the radiating structure comprises at least a concave slot.

4. The device of claim 1, wherein the at least one radiation booster is a planar radiation booster.

5. The device of claim 4, wherein the ground plane layer of the radiating structure comprises at least a concave slot.

6. The device of claim 1, wherein the conducting element of the radiating structure has a non-linear shape.

7. The device of claim 1, wherein the ground plane layer of the radiating structure is printed on a material selected from the group consisting of: FR4, Cuclad and Alumina.

8. A device comprising:

a radiating system of a device configured to operate in multiple bands where a lowest operating frequency is no greater than 698 MHz, the radiating system comprising:

a radiating structure including:

at least one radiation booster;

a ground plane layer connectable to an external ground plane; and a conducting element connecting the at least one radiation booster to the ground plane layer;

an external RF port; and a feeding system including a radiofrequency system and a transmission line arranged along the ground plane layer and connecting the radiofrequency system to the external RF port, wherein a ratio between a height of the radiating structure and a free-space wavelength corresponding to the lowest operation frequency is less than 0.1.

9. The device of claim 8, wherein the ground plane layer of the radiating structure comprises at least a concave conductive surface.

10. The device of claim 9, wherein the ground plane layer of the radiating structure comprises at least a concave slot.

11. The device of claim 8, wherein the at least one radiation booster includes a planar radiation booster.

12. The device of claim 11, wherein the ground plane layer of the radiating structure comprises at least a concave slot.

13. The device of claim 8, wherein the conducting element of the radiating structure has a non-linear shape.

14. The device of claim 8, wherein the ground plane layer of the radiating structure is printed on a material selected from the group consisting of: FR4, Cuclad and Alumina.

15. A device comprising:

a radiating system of a device configured to operate within a first frequency range of 698 MHz to 960 MHz and a second frequency range of 1,710 MHz to 2,690 MHz, the radiating system comprising:

a radiating structure including:

a radiation booster of dimensions 12×2×24 $mm^3$;

a ground plane layer comprising at least a concave conductive surface, the ground plane layer being connectable to an external ground plane; and a conducting element that connects the radiation booster to the ground plane layer;

an external RF port; and a feeding system including a radiofrequency system and a transmission line arranged along the ground plane layer and connecting the radiofrequency system to the external RF port, wherein a ratio between a height of the radiating structure and a free-space wavelength corresponding to a lowest operation frequency of the radiating system is less than 0.1.

16. The device of claim 15, wherein the ground plane layer of the radiating structure comprises at least a concave slot.

17. The device of claim 15, wherein the conducting element of the radiating structure has a non-linear shape.

18. The device of claim 15, wherein the ground plane layer of the radiating structure is printed on a material selected from the group consisting of: FR4, Cuclad and Alumina.

19. The device of claim 1, wherein the transmission line comprises a coaxial transmission line.

20. The device of claim 8, wherein the transmission line comprises a coaxial transmission line.

* * * * *